United States Patent [19]

List et al.

[11] 3,936,918

[45] Feb. 10, 1976

[54] STRAND TREATMENT APPARATUS

[75] Inventors: Ralph W. List, East Lansdowne; Malcolm F. Irwin, West Chester; Robert K. Stanley, Media, all of Pa.

[73] Assignee: Textured Yarn Co., Inc., Kennett Square, Pa.

[22] Filed: Jan. 20, 1975

[21] Appl. No.: 542,443

Related U.S. Application Data

[62] Division of Ser. No. 461,976, April 18, 1974.

[52] U.S. Cl. ..... 28/59; 28/1.6; 28/62; 68/50; 68/204; 226/172; 432/59

[51] Int. Cl.[2] ..... D06C 1/06

[58] Field of Search ..... 28/1.3, 1.6, 59, 62, 72.11, 28/72.14; 226/118, 119, 172; 34/162, 151, 153; 100/151, 153, 118; 68/204, 5; 432/59, 60

[56] References Cited

UNITED STATES PATENTS

| | | | |
|---|---|---|---|
| 1,915,733 | 6/1933 | Hand | 100/152 |
| 2,294,957 | 9/1942 | Caldwell | 28/1.6 |
| 2,825,556 | 3/1958 | Rowe | 226/118 X |
| 3,230,866 | 1/1966 | Branders et al. | 100/151 X |
| 3,259,953 | 7/1966 | Baer | 28/1.3 |
| 3,739,967 | 6/1973 | Jones | 28/1.6 |
| 3,805,342 | 4/1974 | Shattuck | 28/1.3 |

*Primary Examiner*—Louis K. Rimrodt
*Attorney, Agent, or Firm*—Charles A. McClure

[57] ABSTRACT

Conveyor apparatus for temporary holdup of textile strands, especially crimped strands for setting. Screen-like conveyor belts receive the strand between downwardly converging flights and discharge the strand from between upwardly diverging flights. The conveyor apparatus is housed in a heated steam-fed enclosure.

11 Claims, 5 Drawing Figures

STRAND TREATMENT APPARATUS

This is a division of application Ser. No. 461,976, filed Apr. 18, 1974.

STRAND TREATMENT APPARATUS AND METHOD

This invention relates to treatment of textile strands, especially after crimping, twisting, or similar configurational distortion, so as to preserve or "set" at least part of such distortion by concurrently heating such strand and so relieving distortion-induced strains therein.

Known methods of treating textile strands to preserve configurational distortion thereof often function irregularly or add further undesirable distortion thereto, sometimes of particularly objectionable recurrent type. Heat-relaxation aftertreatment poses a risk of uneven exposure and consequently either or both of such undesired results or other untoward effects.

A primary object of the present invention is uniform treatment of configurationally distorted strands to preserve such distortion to desired extent.

Another object is progressive lateral compression and release of such strand for such purpose.

A further object is provision of screenlike conveyor apparatus for accomplishing the foregoing objects.

Other objects of this invention, together with means and methods for attaining the various objects, will be apparent from the following description and the accompanying diagrams of a preferred embodiment presented by way of example rather than limitation.

In general, the objects of the present invention are accomplished by injecting a textile strand into a gorelike downwardly progressing region of diminishing extent, accumulating the strand therein and passing it therethrough and into a gorelike upwardly progressing region of expanding extent, and withdrawing the strand from the latter region, preferably heating the strand throughout, as by suffusing it with steam or other hot fluid.

More particularly, the invention includes, in apparatus for treating textile strands previously subjected to configurational distortion desired to be retained in part, a pair of generally adjacent screens having a gore between mutually converging downward flights and a gore between diverging upward flights, being closest to one another intermediate the gores, at least one of the screens being constrained in part by a roll movable vertically to space the respective screens apart intermediately upon accumulation of strand therebetween.

Figure 1:
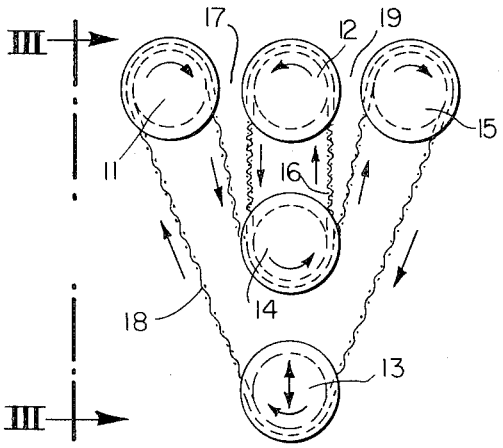
FIG. 1 is a schematic end elevation of conveyor apparatus (empty) according to this invention.

FIG. 1 shows in end view five mutually parallel rolls, including rolls 11 and 15 located at a common level and flanking but spaced from roll 12. Roll 14 is below and spaced from roll 12, and roll 13 is below and spaced from roll 13. First conveyor screen 18 passes in a V-like configuration about rolls 15, 13, and 11 but under roll 14, which not only constrains that first screen but also receives second conveyor screen about itself and roll 12, which together may be viewed as an I-like configuration nested within the V-like configuration. Each roll is flanged to retain the screens thereon, and the directions of rotation are shown by arrows.

The downwardly converging flights of the respective screens form input gore 17 at the left, and output gore 19 at the right of the smaller second conveyor. At the intermediate part of their respective paths, adjacent roll 14, both conveyor screens are contiguous in the absence of strand accumulation therebetween forcing them apart as shown in the next view.

Figure 2:
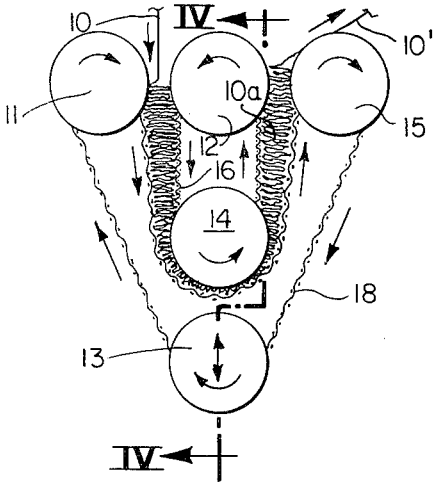
FIG. 2 is a view similar to FIG. 1 but showing textile strand being conveyed thereby.

FIG. 2 shows strand 10 being injected downwardly (as indicated by an arrow) into the first gore and accumulated therein and between the respective screens throughout their intermediate portions (forced apart by intervening strand accumulation 10*a*). The strand accumulation continues into and substantially fills the output gore, from which treated strand 10′ is withdrawn upwardly (and obliquely) over roll 15. Spacing apart at the intermediate part of their paths is permitted by lifting of lowermost roll 13 by the first screen itself, that roll being an idler on a vertically movable axis (as indicated by the double-headed vertical arrow). It will be understood that the other rolls are mounted on fixed axes and that at least one roll about which either conveyor passes is driven rotatively in conventional manner and by conventional means (not shown).

Figure 3:
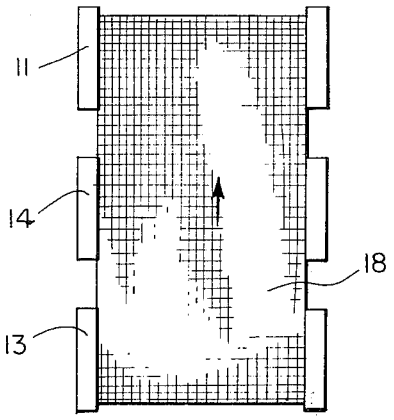
FIG. 3 is a front elevation of the same apparatus, taken at III—III on FIG. 1.
Figure 4:
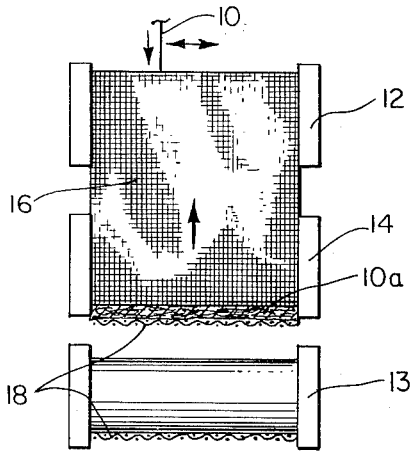
FIG. 4 is a sectional elevation in the opposite direction to FIG. 3 and taken at IV—IV on FIG. 2.

First conveyor screen 18 is relatively coarse as shown in FIG. 3, and second conveyor screen 16 relatively fine as shown in FIG. 4. The latter view also clearly shows strand accumulation 10a between the respective screens beneath roll 14, and the correspondingly raised position of roll 13 from a horizontal line of sight perpendicular to that in FIG. 2.

Figure 5:
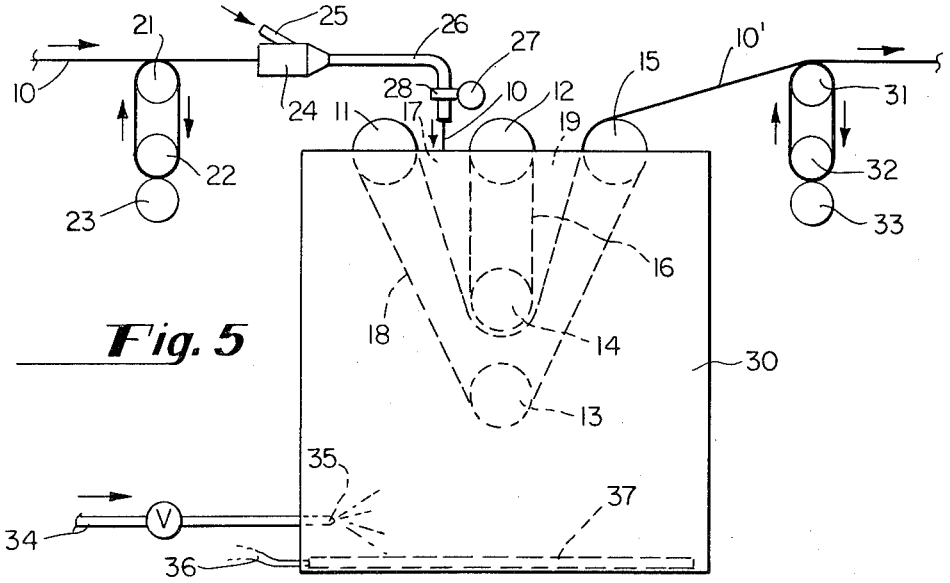
FIG. 5 is a schematic representation of apparatus of this invention including that of the foregoing views.

FIG. 5 shows the foregoing roll arrangement enclosed (to the upper roll axes) in housing 30. Pipe 34 from a suitable source (not shown) of steam or other hot fluid contains valve V and enters the housing to terminate in injection nozzle 35 therein. Electrical heater 37 in the lower part of the housing has pair of wires 36 for connection to an external source (not shown) of electrical power. The heater is capable of heating the enclosure and the hot fluid itself above the normal boiling point of water and may be controlled thermostatically in conventional manner to do so.

FIG. 5 shows schematically strand 10 proceeding as shown by arrows from a suitable source of supply (not shown) and about pair of spaced rolls 21 and 22, including passage through the nip of rolls 22 and 23, thereby being metered at a given rate into forwarding jet 24, which receives air or other suitable forwarding fluid from a source thereof (not shown) into branch inlet tube 25 thereof as indicated by an arrow. Flexible guide tube 26 leads the strand from the jet to a location above input gore 17, along which it is constrained to reciprocate (perpendicular to the plane of the view) by traverse guide 28 driven by slotted cam roll 27 or like traverse means.

From output gore 19 treated strand 10′ is withdrawn, obliquely over roll 15 and the first screen thereover (or, if desired, through a fixed guide located above the gore) to and about pair of spaced rolls 31 and 32, including passage through the nip of rolls 32 and 33, thereby being metered out at a given rate much as the input strand was metered in with the aid of a similar trio of rolls. The output strand may be treated further, be packaged, or be converted directly into fabric or other end use as may be desired.

The output strand is distortion-stabilized relative to the input strand, as may be confirmed by temporary tensioning and length comparison in conventional manner. The uniformity of stabilized characteristics is quite high, apparently because of the gradual application and release of constraint upon the strand and the even suffusion thereof by hot fluid via openings in the coarse outer conveyor screen. The fine screen aids diffusion of the fluid therethrough by permitting some of the fluid to escape through the openings therein, rather than presenting an impermeable barrier that might collect a condensate thereon if the hot fluid is a vapor, such as steam. Although indicated as a woven screen, the conveyors may comprise flexible belts with appropriate openings therethrough.

As an example, stuffer-crimped nylon multifilament having 2 to 5% residual shrinkage before treatment is found to have essentially no residual shrinkage after treatment according to this invention.

It will be apparent that the arrangement of rolls illustrated and described herein may be extended by addition of rolls and lengthening of the first screen into a W-like configuration with two nested I-like conveyor configurations, with means added to assure continuation of the path of accumulated strand from input to output. Other modifications may be made, as by adding, combining, or subdividing parts or steps, or substituting equivalents thereof, while retaining advantages and benefits of this invention--which itself is defined in the following claims.

We claim:

1. In apparatus for setting crimped textile strands, the improvement comprising a relatively coarse conveyor screen, a relatively fine conveyor screen, rotative means constraining the respective screens for travel adjacent one another over a part of their paths, the constraining means including a yieldable arrangement for permitting accumulation of strand between the respective screens to force them apart from one another at a locus of support thereof and means for injecting setting fluid at the side of the coarse screen opposite the strand-contacting surface thereof.

2. Apparatus according to claim 1, including heating means adjacent the fluid-injection means.

3. In apparatus for setting crimped textile strands, a setting chamber, conveyor means within the chamber including a pair of generally adjacent conveyor screens having a gore between mutually converging downward flights thereof and a gore between diverging upward flights thereof, being closest to one another intermediate the gores, means for depositing crimped strand between the downwardly converging flights, and means for withdrawing the strand lengthwise from between the upwardly diverging flights and out of the chamber.

4. Apparatus according to claim 3, wherein at least one of the screens is constrained in part by a roll movable vertically to space the respective screens apart intermediately upon accumulation of strand therebetween.

5. Apparatus according to claim 4, wherein such vertically movable roll is supported by and within one of the conveyor screens, which has a pair of rolls flanking such roll at a higher level than the level of such roll and supporting the ends of such conveyor screen, and wherein the other conveyor screen is essentially vertical and supported by rolls at its opposite ends substantially above such vertically movable roll.

6. Apparatus according to claim 3, including a fluid jet for injecting crimped textile strand between the downwardly converging flights.

7. Apparatus according to claim 6, wherein one of the conveyor screens is coarser in mesh than the other, and including means for injecting setting fluid into the chamber and adjacent the coarser screen.

8. In apparatus for setting crimped textile strands, improved temporary holdup means comprising a pair of conveyor screens with mutually parallel rolls supporting the respective screens; the first screen having a V configuration as viewed edge-on, in the direction of the roll axes, the first screen passing about a first upper roll at one arm extremity of the V, a lower roll at the apex of the V, and a second upper roll at the other arm extremity of the V; the second screen having an I configuration as viewed likewise, the second screen passing about an upper roll and a lower roll, the upper roll of the second screen being located between and spaced from the upper rolls of the first screen, and the lower roll of the second screen being located above and spaced from the lower roll of the first screen; the first screen also being constrained to pass below the lower roll of the second screen and contiguous with the second screen thereat, a housing enclosing the respective lower rolls and extending to the respective upper rolls, means for injecting hot fluid into the housing, and means for heating the housing independently thereof.

9. Apparatus according to claim 8, wherein the injecting means comprises a steam jet.

10. Apparatus according to claim 8, wherein the heating means is electrically powered.

11. Apparatus according to claim 8, including fluid jet means for depositing textile strand into the gore between the adjacent downward flights.

* * * * *